US005756919A

United States Patent [19]

Adachi et al.

[11] Patent Number: 5,756,919

[45] Date of Patent: May 26, 1998

[54] MUSICAL SOUND GENERATING SYSTEM INCLUDING PSEUDO-SINUSOIDAL WAVE OPERATOR

[75] Inventors: Masato Adachi; Junichi Ikeuchi, both of Tokyo, Japan

[73] Assignee: Korg Inc., Tokyo, Japan

[21] Appl. No.: 845,474

[22] Filed: Apr. 25, 1997

Related U.S. Application Data

[63] Continuation of Ser. No. 499,371, Jul. 7, 1995, abandoned.

[30] Foreign Application Priority Data

Jul. 28, 1995 [JP] Japan ..... 6-177074

[51] Int. Cl.[6] ..... G10H 1/08; G10H 5/02

[52] U.S. Cl. ..... 84/660; 84/696; 84/697; 84/DIG. 10

[58] Field of Search ..... 84/622–625, 659–661, 84/692–700, DIG. 10

[56] References Cited

U.S. PATENT DOCUMENTS

| | | | |
|---|---|---|---|
| 4,018,121 | 4/1977 | Chowning . | |
| 4,160,402 | 7/1979 | Schwartz | 84/695 |
| 4,173,164 | 11/1979 | Adachi et al. | 84/694 X |
| 4,249,447 | 2/1981 | Tomisawa . | |
| 4,253,367 | 3/1981 | Hiyoshi et al. . | |
| 4,297,933 | 11/1981 | Nishimoto | 84/622 X |
| 4,554,857 | 11/1985 | Nishimoto . | |
| 4,643,066 | 2/1987 | Oya | 84/624 |
| 4,813,326 | 3/1989 | Hirano et al. . | |
| 5,164,530 | 11/1992 | Iwase | 84/624 |

FOREIGN PATENT DOCUMENTS

| | | |
|---|---|---|
| 55-50299 | 4/1980 | Japan . |
| 58-211789 | 6/1982 | Japan . |

*Primary Examiner*—Stanley J. Witkowski

*Attorney, Agent, or Firm*—Leydig, Voit & Myer, Ltd.

[57] ABSTRACT

A musical sound generating system not requiring a memory unit or interpolation device for generating a tone having a tone color including a large number of harmonic components. The tone is generated with few operations and ready predictability of tone color. The musical sound generating system includes an adder for phase modulating a carrier wave by adding modulating wave data to carrier wave phase angle data; a pseudo-sinusoidal wave operator for outputting a pseudo-sinusoidal wave in response to phase-modulated carrier wave phase angle data from the adder; and a multiplier for generating a tone signal by multiplying the pseudo-sinusoidal wave by amplitude coefficient data. The pseudo-sinusoidal wave operator controls modulation of the pseudo-sinusoidal wave in accordance with a function modulation coefficient that is supplied to the operator as an external parameter. The pseudo-sinusoidal wave operator may include an operator for generating a triangular wave, an operator for squaring the triangular wave, and an operator for producing a substantially sinusoidal wave from a combination of the triangular wave and the squared triangular wave.

13 Claims, 11 Drawing Sheets

2 SERIES

2 TERMS

DUPLEX

MUSICAL SOUND GENERATING SYSTEM INCLUDING PSEUDO-SINUSOIDAL WAVE OPERATOR

This disclosure is a continuation of patent application Ser. No. 08/499,371, filed Jul. 7, 1995, now abandoned.

BACKGROUND OF THE INVENTION

1. Field of the Invention

The present invention relates to musical sound generating systems for use as a sound source for electronic musical instruments.

2. Description of the Related Art

A conventional musical sound synthesizing technique is known to involve frequency modulation within an audio frequency region.

FIG. 13 is a diagram for showing a sound source according to a musical sound synthesizing method of the frequency modulation (hereinafter, referred to as FM) operation type based on a principle similar to that disclosed in Japanese Patent Publication No.54-33525.

Referring to FIG. 13, a first sinusoidal wave table 1 stores sinusoidal wave data $\sin\omega_m t$, which corresponds to modulating wave phase angle data $\omega_m t$. A first multiplier 2 generates modulating wave data $I(t)\times\sin\omega_m t$ by multiplication of the sinusoidal wave data sinmt read out from the sinusoidal wave table 1 by a modulation index data I(t). An adder 3 phase modulates a carrier wave by adding the modulating wave data $I(t)\times\sin\omega_m t$ output from the first multiplier 2 to carrier wave phase angle data ωct. A second sinusoidal wave table 4 stores a sinusoidal wave data sinθ corresponding to phase-modulated carrier wave phase angle dataθ ($=\omega_c t+I(t)\times\sin\omega_m t$) output from the adder 3. A second multiplier 5 multiplies the sinusoidal wave data sinθ by an amplitude coefficient data A(t) to obtain a tone signal Y(t) as:

$$Y(t)=A(t)\times\sin\{\omega_c t+I(t)\times\sin\omega_m t\}.$$

In a musical sound generating system according to the above construction, a tone signal containing many harmonics may be obtained on the basis of: the modulating wave phase angle data $\omega_m t$ and the carrier wave phase angle data ωct from a phase data generating circuit (not shown) which change periodically, corresponding to the pitch of a pressed key in accordance with pressed key data provided from a keyboard circuit (not shown) of an electronic musical instrument; and the modulation index data I(t) and amplitude coefficient data A(t) from an envelope generator (not shown) sequentially changed in time in response to a key on signal generated from a keyboard circuit (not shown) when a key is pressed down.

Further, FIGS. 14A to 14E explain a musical sound generating system similar to that disclosed in Japanese Patent Laid-Open No.58-211789 and in Japanese Patent Publication No.61-2957 in which circuit portions of the tone signal operation part of FIG. 13 as described above are optionally combined in accordance with the concept of operator and algorithm so as to obtain more harmonics.

FIG. 14A shows an operator 6 for indicating a tone signal operation part constituted by the adder 3, second sinusoidal wave table 4 and multiplier 5 in the musical sound generating system as shown in FIG. 13. FIG. 14B shows an algorithm using first to fourth operators 61~64 which is, a connected combination of such operators. FIGS. 14C to 14E show a connection switching concept of the operators in the algorithm shown in FIG. 14B in which: FIG. 14C shows construction of a tone signal operation part consisting of two series connections; FIG. 14D shows construction of a tone signal operation part consisting of two terms; and FIG. 14E shows operation construction of a duplex tone signal operation part. By switching to the operation construction of a multi-series, multi-term, or multiplex tone signal operation in this manner, more harmonic components are obtained so that an optional tone color may be synthesized at will.

In the conventional musical sound generating system, however, a memory unit referred to as second sinusoidal wave table 4 is needed for the operation at the tone signal operation part. If a memory having a small capacity is used, it is necessary to linearly interpolate values read out from the memory or to have a device for interpolation, such as an integrator. Further, there is an disadvantage in the tone synthesizing technique because it is difficult to make a prediction in synthesizing of desired tone color. In addition, if a tone color is to be synthesized so that it possesses sufficient harmonic components, the construction of a tone signal operation part consisting of a simple single series is not sufficient. For this reason, operation of a tone signal operation part consisting of multiple series, a polynomial, a multiplex, etc., is performed as shown in FIGS. 14C to 14E, or it is necessary to provide a method in which, for example, write-in/read-out of the sinusoidal wave table is contrived. As a result, the construction of operation circuit becomes large in size and complicated. A disadvantage thus results in a system where each operation is performed by time division because the control blocks must be processed at a high speed.

SUMMARY OF THE INVENTION

Accordingly, the present invention has been made to eliminate the problems of conventional example. It is an object of the present invention to provide a musical sound generating system in which: a memory unit for a sinusoidal wave table and an interpolation device are not necessary; a tone color having sufficient harmonic components may be synthesized through few operations; and it is easy to predict points at which harmonic components are emphasized.

To achieve the above object, there is provided a musical sound generating system according to the present invention, comprising:

an adder for performing phase modulation of a carrier wave by adding a modulating wave data to a carrier wave phase angle data;

a periodic function operator formed of function generator for operating and outputting a periodic function based on the phase-modulated carrier wave phase angle data output from the adder;

and a multiplier for obtaining a tone signal by multiplication of the periodic function data from the periodic function operator by an amplitude coefficient data.

Thereby a periodic function is obtained without requiring a special memory unit, an interpolation device, etc., and with a small and simple operational construction and, therefore, it is possible to readily obtain a tone signal by a multiplication of such periodic function data by the amplitude coefficient data.

Further, the periodic function operator comprises: a first operator for obtaining a triangular wave output based on an input; a second operator for obtaining squared output of the triangular wave output; and a third operator for obtaining a pseudo-sinusoidal wave output based on the triangular wave output and the squared wave output. It is thereby possible to obtain a pseudo-sinusoidal wave for which control of harmonic components is relatively easy.

Furthermore, in the above periodic function operator, the periodic function to be output is modulation-controlled to produce more harmonic components in accordance with function modulating coefficient provided as parameter. It is thereby possible to improve degree of freedom in producing a sound and to facilitate a prediction in producing a tone color.

Moreover, a tone signal operation part is formed by the adder, the periodic function operator formed of function generator and the multiplier, and a plurality of such tone signal operation parts are connected in a combination to use a multi-series, polynomial or multiplex construction without increasing amount of operation. It is thereby possible to synthesize an optional tone color at will by increasing harmonic components.

Further, by additionally providing another periodic function operator formed of function generator for operating and outputting a periodic function based on modulating wave phase angle data and another multiplier for obtaining the modulating wave data through a multiplication of the periodic function data from said another periodic function operator by a modulation index data, a periodic function may be obtained without requiring a special memory unit, interpolation device, etc., and with using a small-sized, simple operation construction. Thus, modulating wave data may be easily obtained through a multiplication of such periodic function data by the modulation index data.

DESCRIPTION OF THE PREFERRED EMBODIMENTS

Embodiment 1

Figure 1:
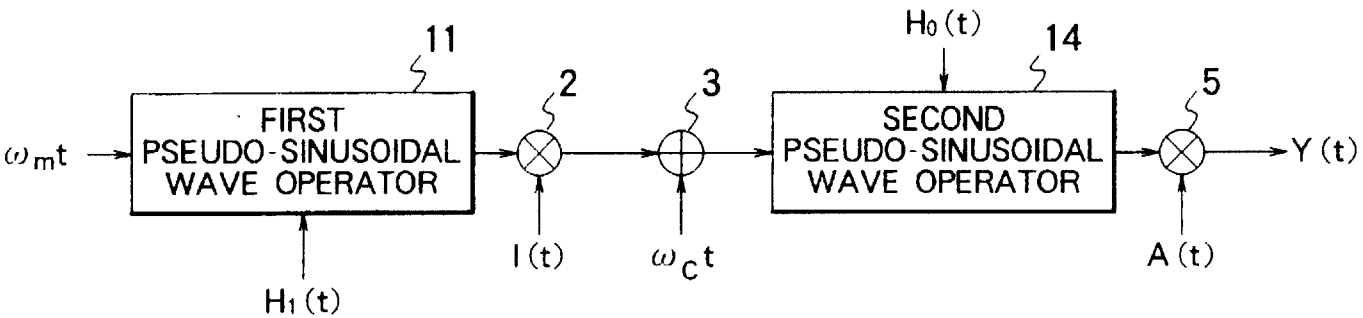
FIG. 1 shows the overall construction of a musical sound generating system according to Embodiment 1 of the present invention.

The present invention will now be described by way of examples illustrated in the drawings.

FIG. 1 shows the construction of a musical sound generating system according to Embodiment 1.

Figure 13:
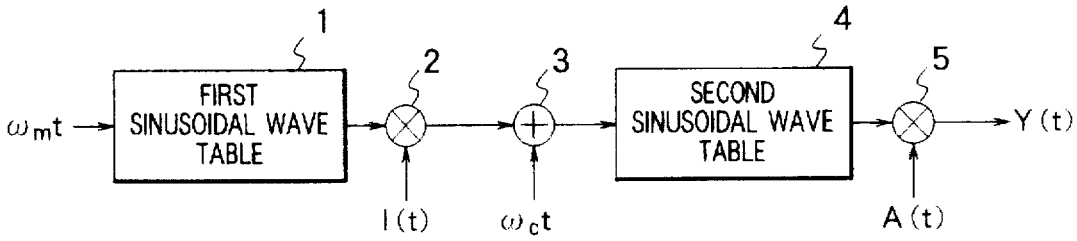
FIG. 13 PRIOR ART
FIG. 13 shows an overall construction of a musical sound generating system according to a conventional example.
Figure 14A:
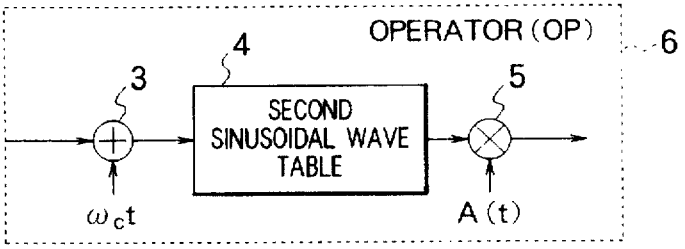
FIG. 14A PRIOR ART
FIGS. 14A to 14E illustrates operators and algorithm for increasing harmonic components according to a conventional example.
Figure 14B:
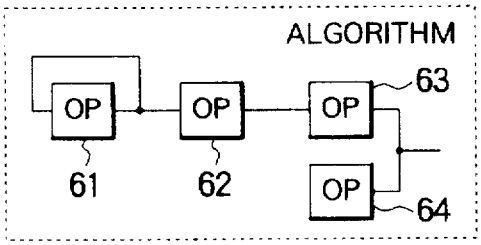
FIG. 14B PRIOR ART
Figure 14C:
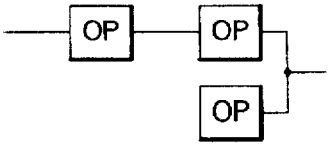
FIG. 14C PRIOR ART
Figure 14D:
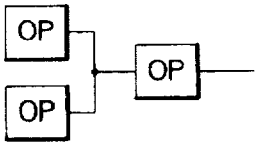
FIG. 14D PRIOR ART
Figure 14E:
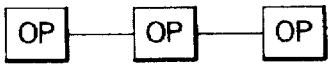
FIG. 14E PRIOR ART

Referring to FIG. 1, identical elements as in the conventional example shown in FIG. 13 are denoted by identical reference numerals and include: a first multiplier 2 for obtaining modulating wave data $I(t)\times\sin\omega_m t$ by multiplication of sinusoidal wave data $\sin\omega_m t$ by modulation index data I(t); an adder 3 for phase modulation of carrier wave by adding the modulating wave data $I(t)\times\sin\omega_m t$ to a carrier wave phase angle data $\omega_c t$; and a second multiplier 5 for obtaining a tone signal Y(t) similar to that of the conventional example through multiplication of sinusoidal wave data output from a pseudo-sinusoidal operator 14 to be described later by amplitude coefficient data A(t).

In addition, as newly added components, first and second pseudo-sinusoidal wave operators 11 and 14 serve as periodic function operators instead of the first and second sinusoidal wave tables 1 and 2 in the conventional example shown in FIG. 13. They are provided with function modulation coefficients $H_1(t)$ and $H_0(t)$ as parameters, respectively, and are function generators for operating and outputting sinusoidal wave data $\sin\omega_m t$ and $\sin\{\omega_c t+I(t)\times\sin\omega_m t\}$ based on input of modulating wave phase angle data $\omega_m t$ and phase-modulated carrier wave phase angle data.

In other words, a distinguishing feature of the musical sound generating system of the construction of FIG. 1 is generation of functions completely without a table conversion such as a sinusoidal wave table. Such functions may be easily processed by providing parameters. By providing changes in parameters with time without generating noise, more harmonic components may be generated to improve the degree of freedom in producing a sound. By effecting real time control of modulation coefficients of functional operators through of simple parameter changes, musical performance information may be actively utilized to provide an easily controllable harmonic arrangement in the output data, and the necessity of inserting a circuit for suppressing noise in real time control of parameters is reduced.

Figure 2:
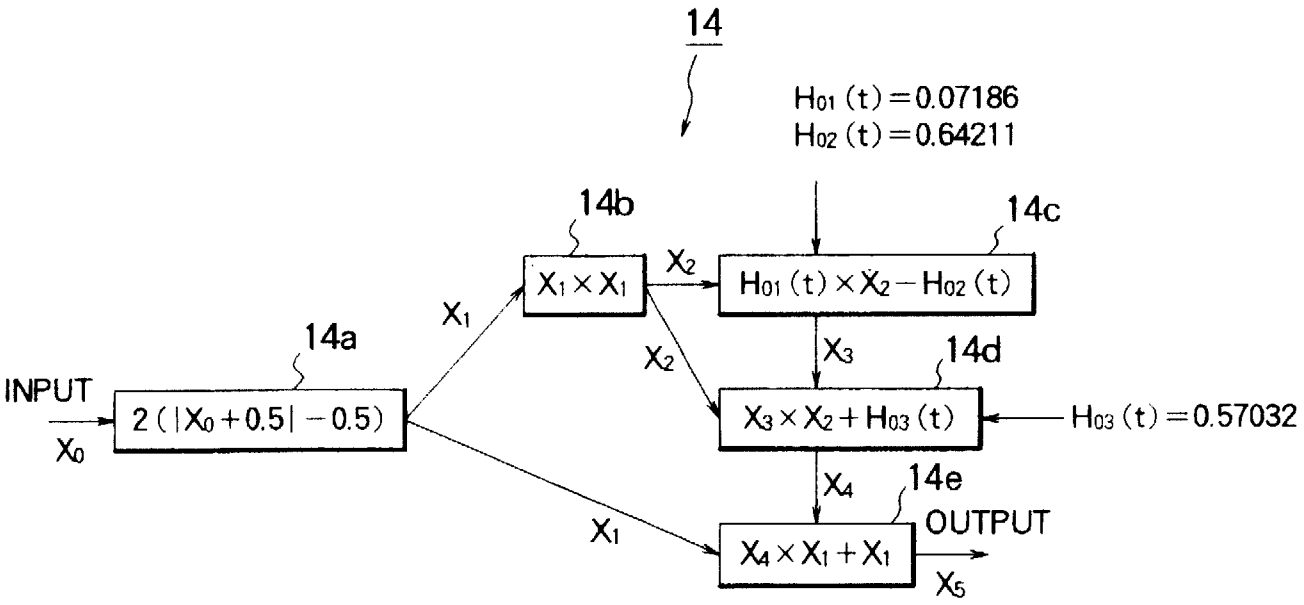
FIG. 2 shows construction of the portion of the pseudo-sinusoidal wave operator of FIG. 1.

Here, for example, the first and second pseudo-sinusoidal wave operators 11 and 14 may be constructed as shown in FIG. 2.

Specifically, FIG. 2 shows the construction of the second pseudo-sinusoidal wave operator 14 intended to be compatible with conventional FM sound sources.

Figure 3C:
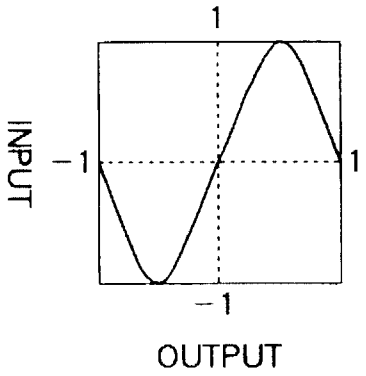
FIGS. 3A to 3C show input/output characteristics of the operators of the respective parts of FIG. 2.
Figure 3B:
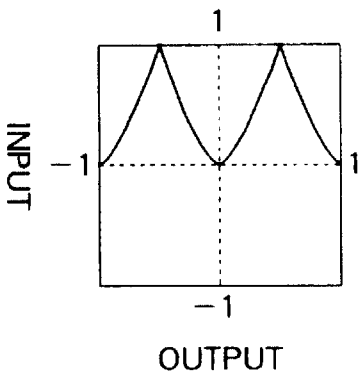
Figure 3A:
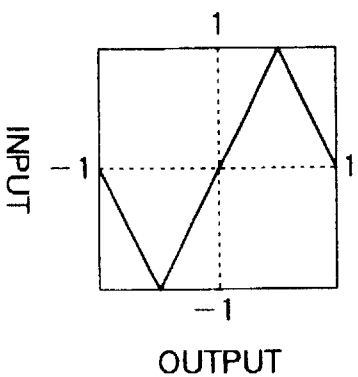

Referring to FIG. 2, a first operator 14*a* calculates by means of unsigned addition a triangular waveform output $X_1=2(|X_0+0.5|-0.5)$ as shown in FIG. 3A from an input $X_0$; a second operator 14*b* receives the output $X_1$ of the first operator 14*a* as an input and calculates an output $X_2=X_1\times X_1$ in the parabolic waveform (squared waveform of triangular wave) as shown in FIG. 3B; and third to fifth operators 14*c* to 14*e* generate a substantially sinusoidal wave as shown in FIG. 3C based on the triangular waveform output $X_1$ from the first operator 14*a* and the parabolic waveform (squared waveform of triangular wave) output $X_2$ from the second operator 14*b*. The third operator 14*c* is supplied with function modulation coefficients of $H_{01}(t)=0.07186$, $H_{02}(t)=0.64211$ and receives $X_2$ as an input, so as to calculate an output $X_3=0.07186\times X_2-0.64211$. The fourth operator 14*d* is supplied with function modulation coefficient of $H_{03}(t)=0.57032$ and receives $X_2$ and $X_3$ as input, and calculate an output $X_4=X_2\times X_3+0.57032$. The fifth operator 14e receives $X_1$ and $X_4$ as input so as to and calculates an output $X_5=X_4\times X_1+X_1$.

It should be noted that FIGS. 3A to 3C show the result of operation when the function modulation coefficient $H_0(t)$ (: $H_{01}(t)\sim H_{03}(t)$) serving a parameter is set to a fixed value for an optional sampling time and is represented by values normalized to a maximum value to 1 and minimum value to −1 of the input/output characteristics of the respective operators. Further, while FIG. 2 shows the construction of the second pseudo-sinusoidal wave operator 14, a similar construction is used also for the first pseudo-sinusoidal wave operator 11.

According to the construction as described above, a function is generated completely without a table conversion such as a sinusoidal wave table. Such functions may be easily processed by providing parameters. By supplying changes in the parameters with time, without generating a noise, a larger number of harmonic components may be generated to improve the degree of freedom in producing a sound. By effecting real time control of modulation coefficients of functional operation by means of simple parameters, musical performance information may be actively utilized and compatibility with conventional sound sources may be provided. Further, the necessity of inserting a circuit for suppressing the occurrence of noise in real time control of parameters is reduced.

Further, when a suitable tone of harmonic arrangement is to be generated in the conventional example, it is necessary to increase number of operation, for example by using a multi-series, polynomial, or multiplex construction as shown in FIGS. 10C to 10E. Further, in such a case, it is very difficult to predict what type of synthesized sound will be produced. Since, in this example, the second pseudo-sinusoidal wave operator 14 will be a function generator, a change in harmonic components with time may be added by varying the function modulation coefficient without increasing the number of operation. A tone generator includes the adder 3, and the second pseudo-sinusoidal wave operator 14 comprising a function generator and the multiplier 5 as shown in FIG. 5. A plurality of tone signal operation parts may be connected in combination in a multi-series, polynomial, or multiplex construction. Thereby, an optional tone color may be synthesized at will by increasing the harmonic components and it is easier to predict with the synthesized sound.

Thus, according to Embodiment 1, since the sinusoidal wave generation means is constituted by a pseudo-sinusoidal wave operator including a function generator for outputting a pseudo-sinusoidal wave, a pseudo-sinusoidal wave may be obtained completely without a table conversion, such as a sinusoidal wave table, thus without requiring a special memory unit, interpolation device, etc., in a small-size, and with simple construction. Such functions may be easily processed by providing parameters. By providing changes in parameters with time without generating noise, a larger number of harmonic components may be generated to improve the degree of freedom in producing a sound. By effecting real time control of modulation coefficients of functional operation by means of simple parameters, musical performance information may be actively utilized to provide an easily controllable harmonic output, and the necessity of inserting a circuit for suppressing the occurrence of noise in real time control of parameter is reduced.

Especially, when a suitable tone harmonic is to be obtained in the conventional example, it is necessary to increase the number of operations, for example, by using a multiplex operation. In such a case, it is very difficult to make a prediction as to what type of synthesized sound will be produced. Since, in this example, the second pseudo-sinusoidal wave operator 14 is constructed as a function generator, a change in harmonic components with time may be made by varying the value of the function modulation coefficient without increasing the number of operations. A tone generating operation part the adder 3, the second pseudo-sinusoidal wave operator 14, a function generator and the multiplier 5. A plurality of tone signal operators may be connected in a combination in a multi-series, polynomial, or multiplex construction so that harmonic components may be increased at will in synthesizing tone color.

Embodiment 2

Figure 4:
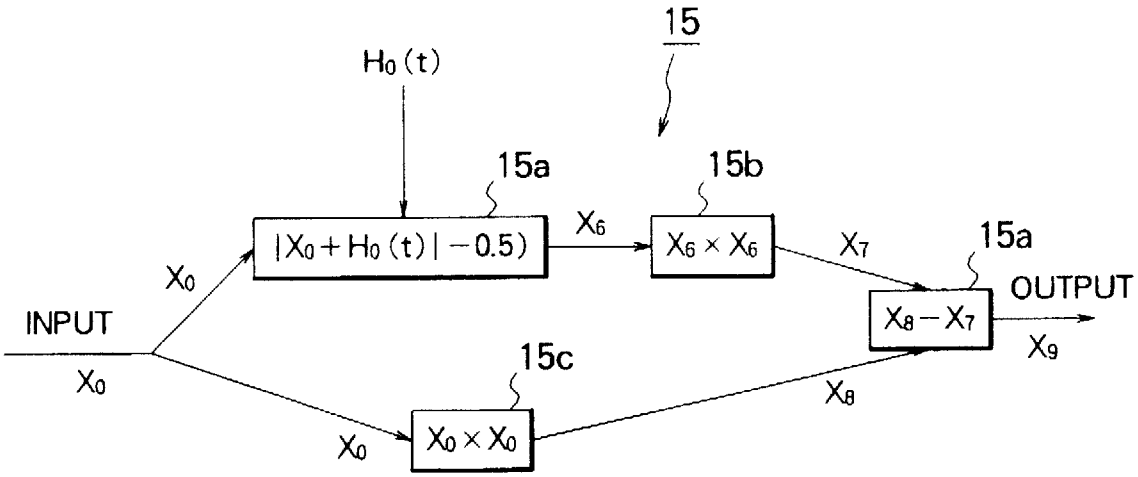
FIG. 4 shows the construction of a pseudo-sinusoidal wave operator portion, explaining a musical sound generating system according to Embodiment 2 of the present invention.

Referring now to FIG. 4 for explaining a musical sound generating system according to Embodiment 2, a construction is shown of first and second pseudo-sinusoidal wave operators 12 and 15 corresponding to the first and second pseudo-sinusoidal wave operators 11 and 14 according to Embodiment 1 shown in FIG. 1. In Embodiment 2, more harmonics than a sound source of the conventional example. FIG. 4 shows an example of the construction of the second pseudo-sinusoidal wave operator 15.

Figure 5A:
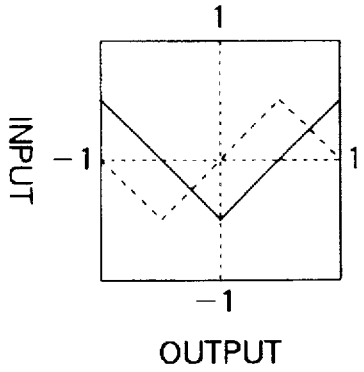
FIGS. 5A to 5D show input/output characteristics of the operators of the respective parts of FIG. 4.
Figure 5B:
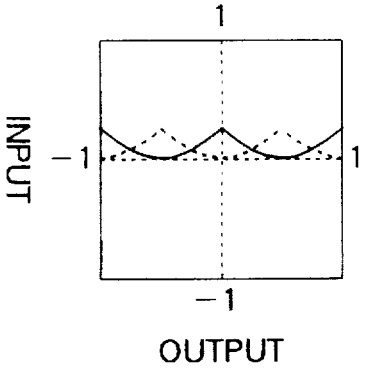
Figure 5C:
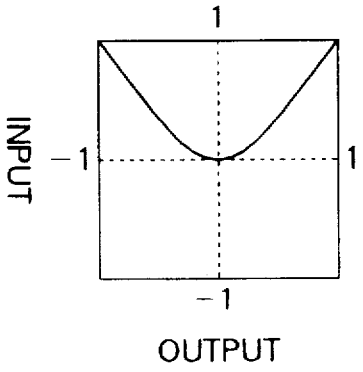
Figure 5D:
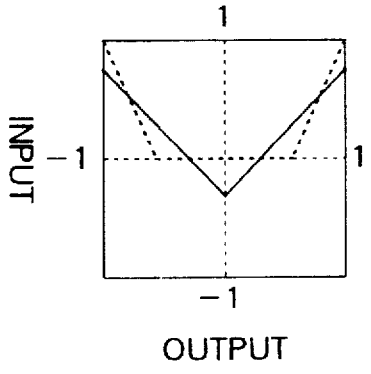

In FIG. 4, a sixth operator 15a receives $X_0$ as an input when function modulation coefficient $H_0(t)=0.0$ and calculates by means of unsigned addition an output $X_6=|X_0+H_0(t)|-0.5$ in the triangular waveform as shown as FIG. 5A. A seventh operator 15b receives the output $X_6$ of the sixth operator 15a as an input and calculates an output $X_7=X_6\times X_6$ in the parabolic waveform (squared waveform of triangular wave) as shown in FIG. 5B. An eighth operator 15c receives $X_0$ as an input and calculates an output $X_8=X_0\times X_0$ in the parabolic waveform (squared waveform of triangular wave) as shown in FIG. 5C. A ninth operator 15d calculates an output $X_9=X_8-X_7$ based on the triangular waveform output $X_7$ from the seventh operator 15b and the triangular waveform output $X_8$ from the eighth operator 15c and outputs it as a pseudo-sinusoidal wave having a waveform as shown in FIG. 5D.

It should be noted that FIGS. 5A to 5D show the result of operation when the function modulation coefficient $H_0(t)$ is set to a fixed value in an optional sampling time and represent values normalized to a maximum value to 1 and minimum value to −1 of the input/output characteristics of the respective operators. Further, while FIG. 4 shows the construction of the second pseudo-sinusoidal wave operator 15, a similar construction is used also for the first pseudo-sinusoidal wave operator 12.

Figure 6A:
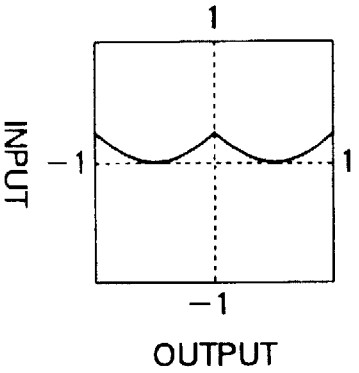
FIGS. 6A to 6F show input/output characteristics of the second and fourth operators when the function modulation coefficient is varied.
Figure 6B:
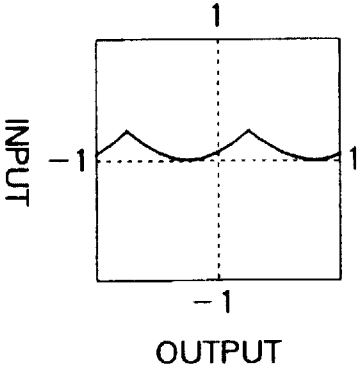
Figure 6C:
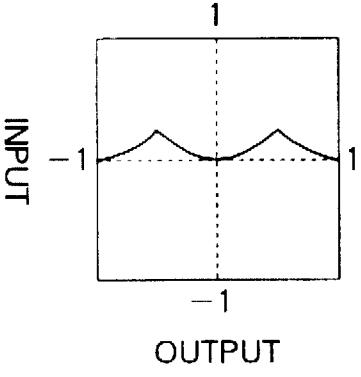
Figure 6D:
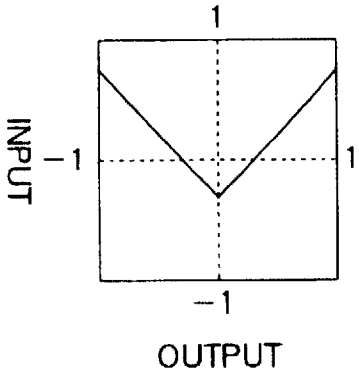
Figure 6E:
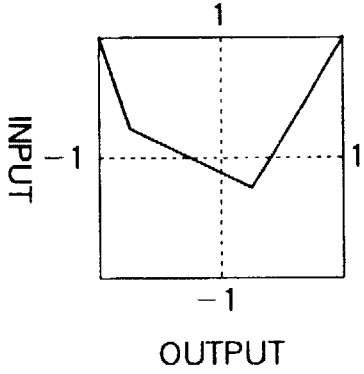
Figure 6F:
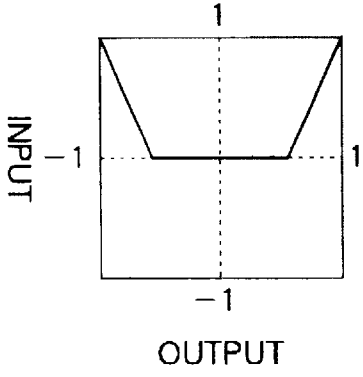

Here, if the function modulation coefficient $H_0(t)$ is varied in the range from 0.0 to 0.5, outputs of the seventh operator 15b and the ninth operator 15d may be varied, respectively, for example, as shown in FIGS. 6A to 6F. Specifically, FIGS. 6A to 6C show outputs of the seventh operator 15b and FIGS. 6D to 6F show outputs of a ninth operators 15d corresponding thereto. By adding sinuosities that occur when frequencies are slightly shifted by using a triangular wave, which has more harmonics and is more readily controllable than a sinusoidal wave, frequency modulation may be effected. It is also possible to modulate the coefficient which corresponds to a shift in frequency.

Thus, according to Embodiment 2, a triangular wave which has more harmonics and is more readily controllable than a sinusoidal wave is used to add sinuosities that occur when frequencies are slightly shifted by means of a diagrammatic operation. Thereby, there is an advantage that frequency modulation may be effected and a coefficient corresponding to a shift in frequency may be modulated to generate more harmonics.

Embodiment 3

Figure 7:
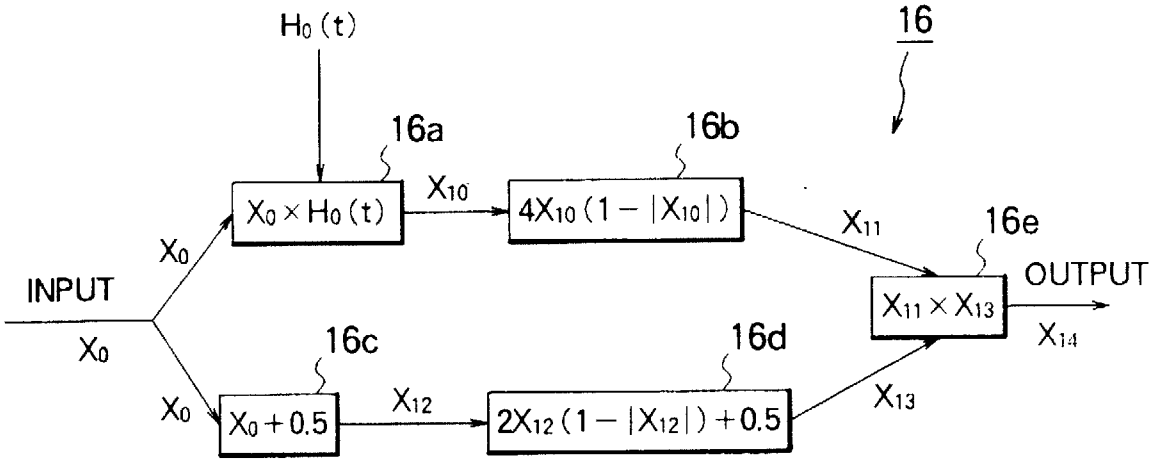
FIG. 7 shows the construction of a pseudo-sinusoidal wave operator portion, explaining a musical sound generating system according to Embodiment 3 of the present invention.

Referring now to FIG. 7 for explaining a musical sound generating system according to Embodiment 3, a construction is shown of first and second pseudo-sinusoidal wave operators 13 and 16 corresponding to the first and second pseudo-sinusoidal wave operators 11 and 14 according to Embodiment 1 shown in FIG. 1, emphasizing easier control than a conventional sound source. FIG. 7 shows an example of the construction of the second pseudo-sinusoidal wave operator 16.

Figure 8A:
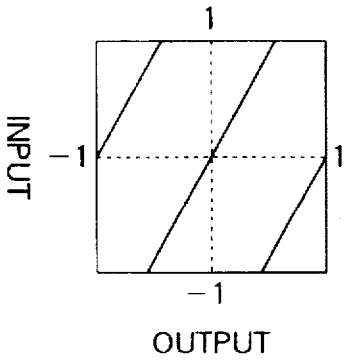
FIGS. 8A to 8E show input/output characteristics of the operators of the respective parts of FIG. 7.
Figure 8B:
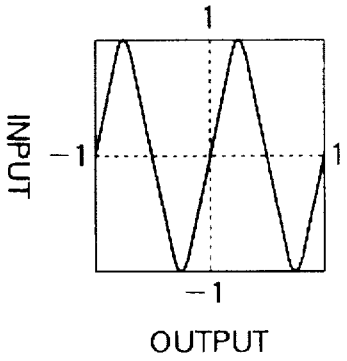
Figure 8C:
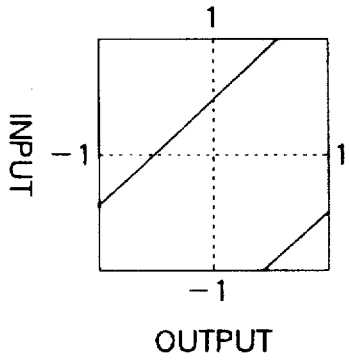
Figure 8D:
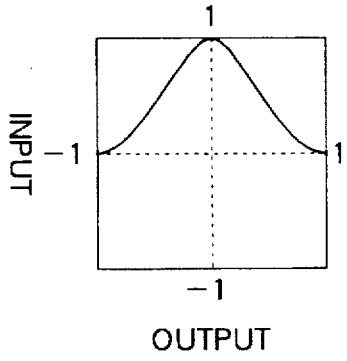
Figure 8E:
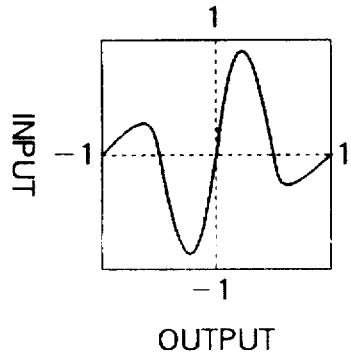

In FIG. 7, a tenth operator 16*a* is provided with a function modulation coefficient $H_0(t)$ and receives $X_0$ as an input and calculates, by unsigned multiplication, an output $X_{10}=X_0\times H_0(t)$ as a linear waveform, for example, as shown in FIG. 8A. An eleventh operator 16*b* receives the output $X_{10}$ of the tenth operator 16*a* as an input and calculates an output $X_{11}=4X_{10}(1-|X_{10}|)$, the sinusoidal waveform as shown in FIG. 8B. A twelfth operator 16*c* receives $X_0$ as an input and calculates, by unsigned addition, a linear waveform output $X_{12}=X_0+0.5$ as shown in FIG. 8C. A thirteenth operator 16*d* receives the linear waveform output $X_{12}$ from the twelfth operator 16*c* as an input and calculates a parabolic waveform output $X_{13}=2X_{12}(1-|X_{12}|)+0.5$ as shown in FIG. 8D. A fourteenth operator 16*e* multiplies the sinusoidal waveform output $X_{11}$ from the eleventh operator 16*b* by the parabolic waveform output $X_{13}$ from the thirteenth operator 16*d* to obtain an output $X_{14}=X_{11}\times X_{13}$ and outputs the waveform shown in FIG. 8E as a pseudo-sinusoidal wave.

It should be noted that FIGS. 8A to 8E show the result of operation when the function modulation coefficient $H_0(t)$ serving as parameter is set to a fixed value (2.0) in an optional sampling time and the results are represented by normalized values with the maximum value of 1 and minimum value of −1 of the input/output characteristics of the respective operators. Further, while FIG. 7 shows the construction of the second pseudo-sinusoidal wave operator 16, a similar construction is used also for the first pseudo-sinusoidal wave operator 13.

Here, the tenth and eleventh operators 16*a* and 16*b* are responsible for oscillating terms of the output signal and the twelfth and thirteenth operators 16*c* and 16*d* are responsible for damping terms in the output signal. The oscillating terms determine spectral peaks of the output signal and the damping terms determine the spectral envelope of the carrier wave. Specifically, frequency of the waveform is determined at the tenth operator 16*a* and it is processed into a waveform with fewer harmonic components at the eleventh operator 16*b*. Further, in order to produce an accurate pitch, a time window of waveform with fewer harmonic components is formed in the twelfth and thirteenth operators 16*c* and 16*d*.

The reason for this is that, if the function modulation coefficient is not an integer, the tenth and eleventh operators 16*a* and 16*b* produce a discontinuity in the waveform, generating a large number of harmonic components which are not related to the pitch and are not wanted. It is thus necessary to reduce the number of such unwanted harmonic components by providing the time window in synchronization with the pitch. By establishing the time window by means of the tenth and eleventh operators 16*c* and 16*d*, characteristics of the spectrum of the carrier wave remain in the overall spectrum of the output waveform. As a result, peak frequencies of the spectrum and the harmonic level of higher harmonic bands may be determined independently from the modulating wave so that it is easier to make a prediction in producing tone color.

Thus, according to Embodiment 3, oscillating terms of the output signal are served by the tenth and eleventh operators 16*a* and 16*b* while damping terms in the output signal are served by the twelfth and thirteenth operators 16*c* and 16*d*. The oscillating terms determine spectral peaks of the output signal while the damping terms determine the spectral envelope of the carrier wave. Therefore, frequency of the waveform is determined at the tenth operator 16*a* and it is processed into a waveform with fewer harmonic components at the eleventh operator 16*b*. Further, in order to produce an accurate pitch, a time window of a waveform with fewer harmonic components is formed at the twelfth and thirteenth operators 16*c* and 16*d* so that characteristics of the spectrum of the carrier wave remain in the overall spectrum of the output waveform. As a result, there is an advantage that peak frequencies of the spectrum and harmonic level of higher harmonic bands may be determined independently from the modulating wave to facilitate the prediction of tone color.

It should be noted that the combination of the pseudo-sinusoidal wave operators 11 and 14, 12 and 15, 13 and 16 serving as periodic function operators used in Embodiments 1 to 3 shown in FIGS. 2, 4, and 7, respectively, is optional for each embodiment. In addition to the combinations of operators of the same construction, any different combination of the pseudo-sinusoidal operators shown in FIGS. 2, 4 and 7 may be made. Naturally, for example, a combination of pseudo-sinusoidal operators 11 and 15, 12 and 16, or 13 and 14 may also be used.

Further, the operator construction in each embodiment may be achieved by an inexpensive universal DSP, and, of course, an inexpensive and simple construction may be used.

Embodiment 4

Figure 9:
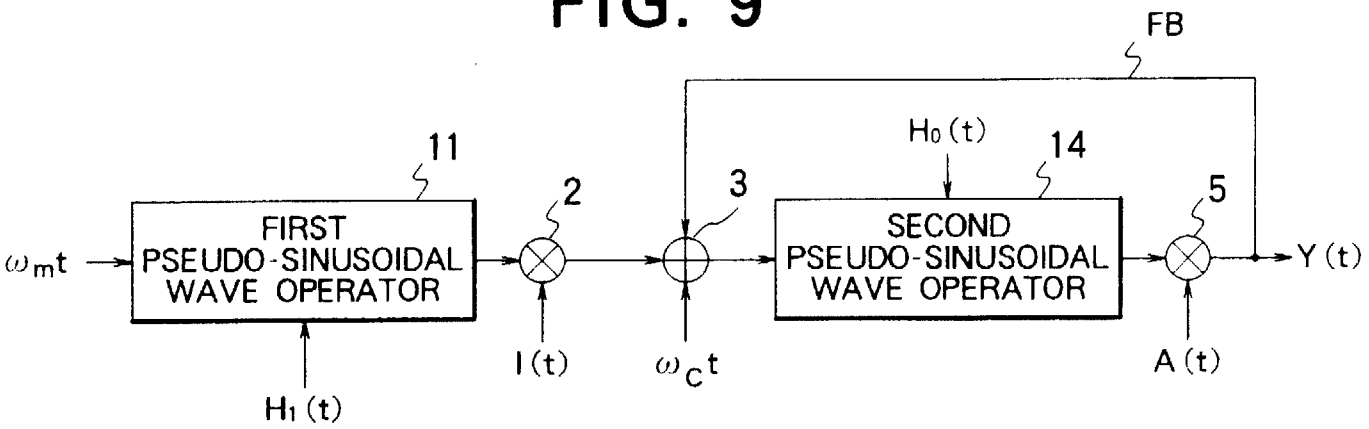
FIG. 9 shows the overall construction of a musical sound generating system according to Embodiment 4 of the present invention.

FIG. 9 is a block diagram showing a musical sound generating system according to Embodiment 4.

The musical sound generating system of FIG. 9 includes, in addition to the construction shown in FIG. 1, a feedback loop FB for providing an additional input to the adder 3 by feeding back the output of the second multiplier 5. It is thereby possible to obtain an output similar to that of the construction having two series-connected tone generating operators parts each consisting of an adder 3, second pseudo-sinusoidal wave opeator 14, and multiplier 5. Simplification of the system may be achieved as it does not require any increase in its operational construction and, at the same time, it is possible to produce harmonic components of continuous frequencies.

Embodiment 5

Figure 10:
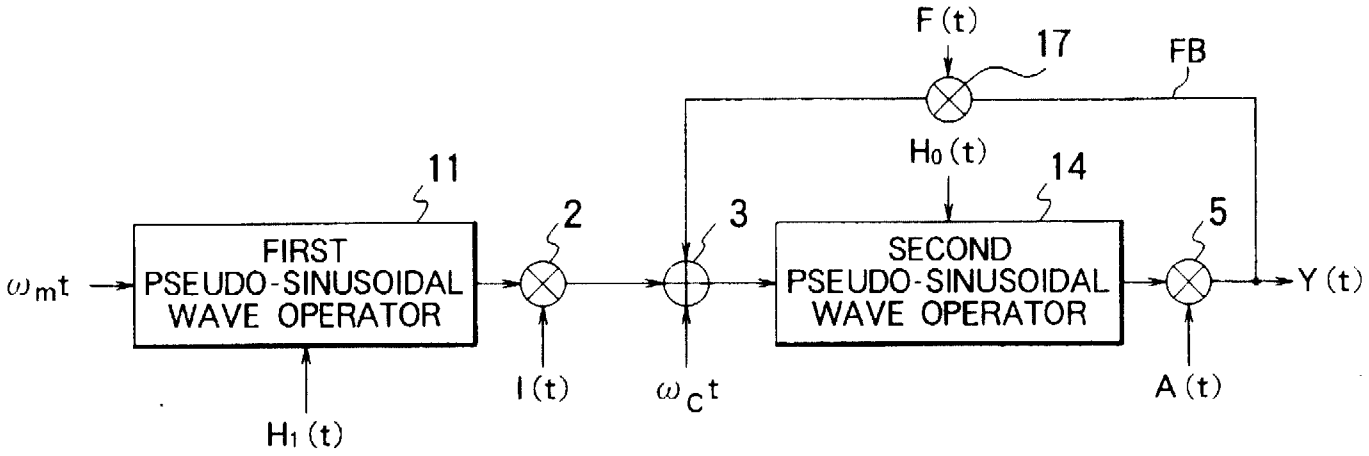
FIG. 10 shows the overall construction of a musical sound generating system according to Embodiment 5 of the present invention.

FIG. 10 is a block diagram showing a musical sound generating system according to Embodiment 5.

The musical sound generating system of FIG. 10 includes, in addition to the construction shown in FIG. 9, a first feedback multiplier 17 for multiplying the output of the second multiplier 5 by a feedback parameter coefficient F(t), the output of the multiplier 17 being an additional input to the adder 3. In comparison with Embodiment 4, it is thus possible to optionally control the generated harmonic components of continuous frequencies by setting of the feedback parameter coefficient F(t).

Embodiment 6

Figure 11:
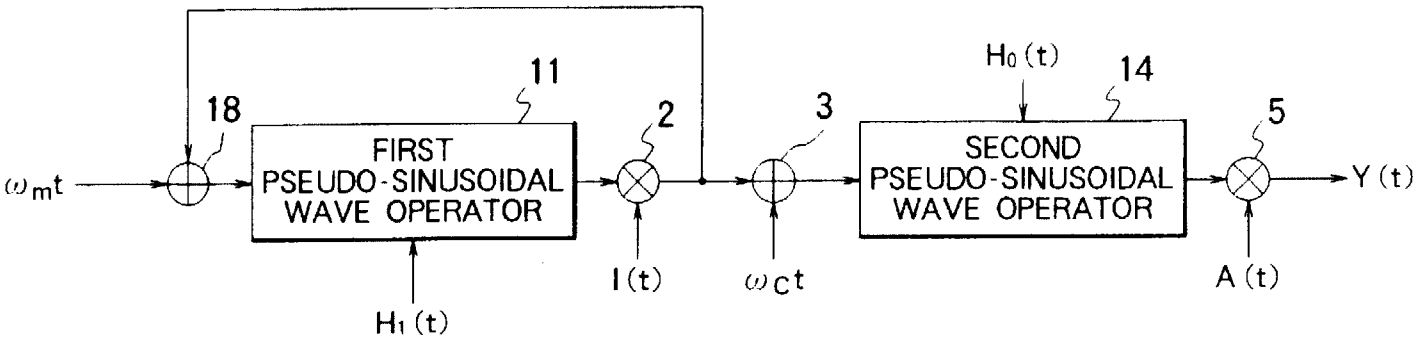
FIG. 11 shows the overall construction of a musical sound generating system according to Embodiment 6 of the present invention.

FIG. 11 is a block diagram showing a musical sound generating system according to Embodiment 6.

The musical sound generating system of FIG. 11 includes, in addition to the construction shown in FIG. 1, a feedback adder 18 for adding the feedback output of the first multiplier 2 to the modulating wave phase angle data ωmt, the output of the adder 18 being an input to the first pseudo-sinusoidal wave operator 11. In a similar manner as in Embodiment 4, a simplification of the construction for obtaining a modulating wave data may be achieved as no increase in its operational construction is required and, at the same time, it is possible to obtain harmonic components of continuous frequencies.

Embodiment 7

Figure 12:
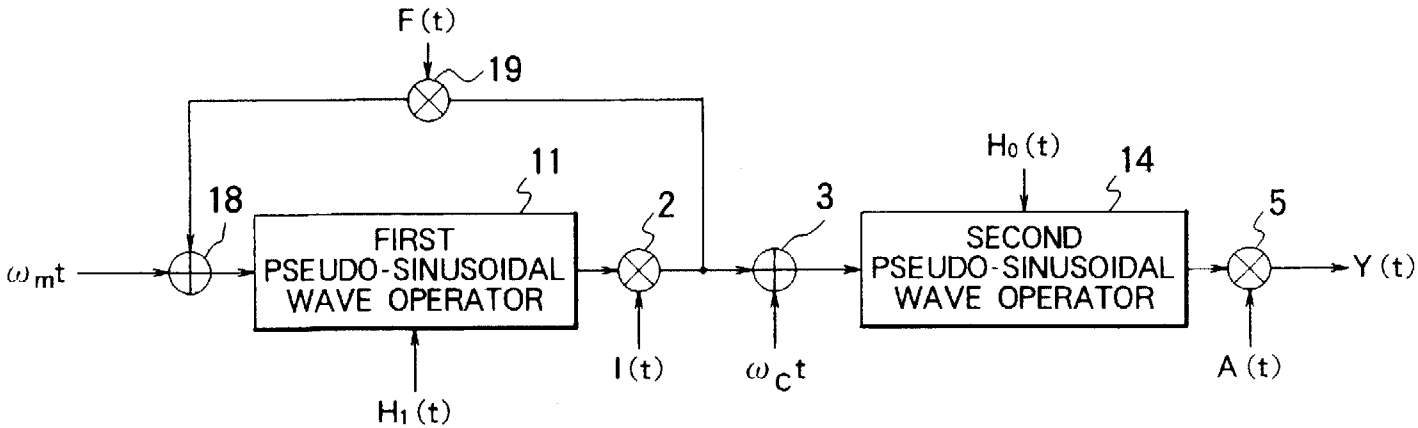
FIG. 12 shows the overall construction of a musical sound generating system according to Embodiment 7 of the present invention.

FIG. 12 is a block diagram showing a musical sound generating system according to Embodiment 7.

The musical sound generating system of FIG. 12 includes, in addition to the construction shown in FIG. 11, a multiplier 19 for multiplying the output of the first multiplier 2 by a feedback parameter coefficient F(t), the output of multiplication being an input to the feedback adder 18 as an feedback output. In comparison with Embodiment 6, it is thus possible to optionally control the generated harmonic components of continuous frequencies by means of setting of the feedback parameter coefficient F(t).

As described above, in accordance with the musical sound generating system of the present invention, a sinusoidal wave generation means includes a periodic function operator comprising function generators for operating on and outputting a periodic function based on a phase-modulated carrier wave phase angle data output from an adder. Thereby, a periodic function is obtained without requiring a special memory unit, interpolation device, etc., in a small-size, and with a simple construction. Thus, there is an advantage that a tone signal may be easily obtained through a multiplication of such periodic function data by amplitude coefficient data.

Further, a tone signal operator includes an adder for obtaining phase-modulated carrier wave phase angle data, a periodic function operator comprising a function generator and a multiplier for obtaining a tone signal from such periodic function data multiplied by amplitude coefficient data. By combining a plurality of tone signal operators, there is an advantage that a multi-series, polynomial or multiplex construction may be used without increasing the number of operations so that harmonic components may be increased to synthesize an optional tone color at will.

Further, by additionally providing a periodic function operator including a function generator for outputting a periodic function based on the modulating wave phase angle data and another multiplier for obtaining the modulating wave data through multiplication of the periodic function data from the periodic function operator by a modulation index data, a periodic function is obtained without requiring a special memory unit, an interpolation device, etc., in a small-size, and with a simple construction. Thus, there is an advantage that a modulating wave data may be easily obtained by multiplication of such periodic function data by modulation index data.

Further, by constructing the above periodic function operator such that the periodic function to be output is modulation-controlled in accordance with function modulating coefficients that are provided as parameters, there is an advantage that it is possible to generate more harmonic components so as to improve degree of freedom in producing a sound and also to facilitate prediction of tone color.

Furthermore, the periodic function operator comprises: a first operator for producing a triangular waveform output on the basis of an input; a second operator for producing a squared output of the triangular waveform output; and a third operator for producing a pseudo-sinusoidal wave output based on the triangular waveform output and the squared waveform output, achieving an advantage in that it is possible to obtain a periodic function in which control of harmonic components is easier.

What is claimed is:

1. A musical sound generating system comprising:

an adder for phase modulating a carrier wave by adding modulating wave data to carrier wave phase angle data;

a periodic function operator free of a memory, connected to said adder, and including a pseudo-sinusoidal wave operator for generating a substantially sinusoidal wave signal in response to phase-modulated carrier wave phase angle data output by said adder, wherein said periodic function operator effects modulation control of the substantially sinusoidal wave signal in accordance with a function modulation coefficient provided as a parameter and said adder is not directly connected to a memory storing digital amplitude signal data, said pseudo-sinusoidal wave operator comprising:

1) triangular wave operation means for generating a triangular wave output signal in response to the phase-modulated carrier wave phase angle data, 2) squared wave operation means for squaring the triangular wave output signal, and 3) pseudo-sinusoidal wave operation means for generating the substantially sinusoidal wave output signal in response to the triangular wave output signal and the squared triangular wave output signal; and a multiplier for producing a tone signal as an output through multiplication of the substantially sinusoidal wave signal by amplitude coefficient data.

2. A musical sound generating system comprising:

an adder for phase modulating a carrier wave by adding modulating wave data to carrier wave phase angle data;

a first periodic function operator free of a memory, connected to said adder, and including a first pseudo-sinusoidal wave operator for generating a substantially sinusoidal wave signal in response to phase-modulated carrier wave phase angle data output by said adder, wherein said first periodic function operator effects modulation control of the substantially sinusoidal wave signal in accordance with a function modulation coefficient provided as a parameter and said adder is not directly connected to a memory storing digital amplitude signal data, said periodic function operator comprising:

a first operator receiving an input $X_0$ and calculating by means of unsigned addition a triangular waveform output $$X_1=2(|X_0+0.5|-0.5);$$

a second operator receiving the output $X_1$ as an input and calculating an output $X_2=X_1\times X_1$, a squared waveform of the triangular wave;

a third operator supplied with function modulation coefficients $H_{01}(t)$ and $H_{02}(t)$ as parameters, receiving the output $X_2$ as an input, and calculating an output $$X_3=H_{01}(t)\times X_2-H_{02}(t);$$

a fourth operator supplied with function modulation coefficient $H_{03}(t)$ as a parameter, receiving the outputs $X_2$ and $X_3$ as inputs, and calculating an output $X_4=X_2\times X_3+H_{03}(t)$; and a fifth operator receiving the outputs $X_1$ and $X_4$ as inputs, and calculating an output $X_5=X_4\times X_1+X_1$ to generate the substantially sinusoidal wave signal; and a multiplier for producing a tone signal as an output through multiplication of the substantially sinusoidal wave signal by amplitude coefficient data.

3. The musical sound generating system according to claim 2, further comprising a feedback loop for feeding back the output of said multiplier to said adder as an input to said adder.

4. The musical sound generating system according to claim 3, further comprising:

a second periodic function operator including a second pseudo-sinusoidal wave operator for generating a second substantially sinusoidal wave signal in response to modulating wave phase angle data; and a second multiplier for generating the modulating wave data through multiplication of the output of said second periodic function operator by modulation index data.

5. The musical generating system according to claim 3, wherein said feedback loop further comprises a feedback multiplier for generating a feedback output by multiplying the output of said multiplier by a feedback parameter coefficient, the feedback output of said feedback multiplier being an input to said adder.

6. The musical sound generating system according to claim 5, further comprising:

a second periodic function operator including a second pseudo-sinusoidal wave operator for generating a second substantially sinusoidal wave signal in response to modulating wave phase angle data; and a second multiplier for generating the modulating wave data through multiplication of the output of said second periodic function operator by modulation index data.

7. A musical sound generating system comprising:

an adder for phase modulating a carrier wave by adding modulating wave data to carrier wave phase angle data;

a periodic function operator free of a memory, connected to said adder, and including a pseudo-sinusoidal wave operator for generating a substantially sinusoidal wave signal in response to phase-modulated carrier wave phase angle data output by said adder, wherein said periodic function operator effects modulation control of the substantially sinusoidal wave signal in accordance with a function modulation coefficient provided as a parameter and said adder is not directly connected to a memory storing digital amplitude signal data, said periodic function operator comprising:

a first operator receiving $X_0$ as an input, supplied with a function modulation coefficient $H_0(t)$, and calculating by means of unsigned addition a triangular waveform output $X_6=|X_0+H_0(t)|-0.5$;

a second operator receiving the output $X_6$ as an input and calculating an output $X_7=X_6\times X_6$, a squared waveform of the triangular wave;

a third operator receiving $X_0$ as an input and calculating an output $X_8=X_0\times X_0$, a squared waveform of the triangular waves; and a fourth operator calculating an output $X_9=X_8-X_7$ to generate the substantially sinusoidal wave signal; and a multiplier for producing a tone signal as an output through multiplication of the substantially sinusoidal wave signal by amplitude coefficient data.

8. A musical sound generating system comprising:

an adder for phase modulating a carrier wave by adding modulating wave data to carrier wave phase angle data;

a first periodic function operator free of a memory, connected to said adder, and including a first pseudo-sinusoidal wave operator for generating a substantially sinusoidal wave signal in response to phase-modulated carrier wave phase angle data output by said adder, wherein said first periodic function operator effects modulation control of the substantially sinusoidal wave signal in accordance with a function modulation coefficient provided as a parameter and said adder is not directly connected to a memory storing digital amplitude signal data, said periodic function operator comprising:

a first operator supplied with a function modulation coefficient $H_0(t)$, receiving $X_0$ as an input, and calculating by means of unsigned multiplication a linear waveform output $X_{10}=X_0\times H_0(t)$;

a second operator receiving the output $X_{10}$ as an input and calculating a sinusoidal waveform output $X_{11}=4X_{10}(1-|X_{10}|)$;

a third operator receiving $X_0$ as an input and calculating by means of unsigned addition a linear waveform output $X_{12}=X_0+0.5$;

a fourth operator receiving the linear waveform output $X_{12}$ as an input and calculating a parabolic waveform output $X_{13}=2X_{12}(1-|X_{12}|)+0.5$;

a fifth operator calculating an output $X_{14}=X_{11}\times X_{13}$ to generate the substantially sinusoidal wave signal; and a multiplier for producing a tone signal as an output through multiplication of the substantially sinusoidal wave signal by amplitude coefficient data.

9. The musical sound generating system according to claim 8, further comprising a feedback loop for feeding back the output of said multiplier to said adder as an input to said adder.

10. The musical sound generating system according to claim 9, further comprising:

a second periodic function operator including a second pseudo-sinusoidal wave operator for generating a second substantially sinusoidal wave signal in response to modulating wave phase angle data; and a second multiplier for generating the modulating wave data through multiplication of the output of said second periodic function operator by modulation index data.

11. The musical generating system according to claim 9, wherein said feedback loop further comprises a feedback multiplier for generating a feedback output by multiplying the output of said multiplier by a feedback parameter coefficient, the feedback output of said feedback multiplier being an input to said adder.

12. The musical sound generating system according to claim 11, further comprising:

a second periodic function operator including a second pseudo-sinusoidal wave operator for generating a second substantially sinusoidal wave signal in response to modulating wave phase angle data; and a second multiplier for generating the modulating wave data through multiplication of the output of said second periodic function operator by modulation index data.

13. A musical sound generating system comprising:

an adder for phase modulating a carrier wave by adding modulating wave data to carrier wave phase angle data;

a first periodic function operator free of a memory, connected to said adder, and including a first pseudo-sinusoidal wave operator for generating a substantially sinusoidal wave signal in response to phase-modulated carrier wave phase angle data output by said adder, wherein said first periodic function operator effects modulation control of the substantially sinusoidal wave signal in accordance with a function modulation coefficient provided as a parameter and said adder is not directly connected to a memory storing digital amplitude signal data;

a multiplier for producing a tone signal as an output through multiplication of the substantially sinusoidal wave signal by amplitude coefficient data;

a second periodic function operator including a second pseudo-sinusoidal wave operator for generating a second substantially sinusoidal wave signal output in response to modulating wave phase angle data, said second pseudo-sinusoidal wave operator comprising:

triangular wave operation means for generating a triangular wave output signal in response to the modulating wave phase angle data;

squared wave operation means for squaring the triangular wave output signal; and pseudo-sinusoidal wave operation means for generating the second substantially sinusoidal wave signal output in response to the triangular wave output signal and the squared triangular wave output signal; and a second multiplier for generating the modulating wave data through multiplication of the output of said second periodic function operator by modulation index data.

* * * * *

UNITED STATES PATENT AND TRADEMARK OFFICE

CERTIFICATE OF CORRECTION

PATENT NO. : 5,756,919
DATED : May 26, 1998
INVENTOR(S) : Adachi et al.

It is certified that error appears in the above-identified patent and that said Letters Patent is hereby corrected as shown below:

Title page:

Item 30, Foreign Application Priority Data, change "1995" to --1994--.

Signed and Sealed this

Tenth Day of November 1998

Bruce Lehman

*Attest:*

BRUCE LEHMAN

*Attesting Officer*

*Commissioner of Patents and Trademarks*